United States Patent [19]

Norman

[11] Patent Number: 5,024,446

[45] Date of Patent: Jun. 18, 1991

[54] INDICATING MEANS FOR TETHERBALL GAME

[76] Inventor: Neville M. Norman, 90 Sandyhurst La., Ashford, Kent, United Kingdom

[21] Appl. No.: 547,588

[22] Filed: Jul. 3, 1990

[51] Int. Cl.[5] ..... A63B 67/00

[52] U.S. Cl. ..... 273/413

[58] Field of Search ..... 273/413, 200 R, 200 B, 273/319, 320, 321, 329, 330, 331, 332, 333, 334, 335, 58 C

[56] References Cited

U.S. PATENT DOCUMENTS

| | | | |
|---|---|---|---|
| 2,140,411 | 12/1938 | Wood | 273/413 |
| 2,297,118 | 9/1942 | Wildegans | 273/400 B |
| 2,423,198 | 7/1947 | McClure, Jr. | 273/414 X |
| 2,458,668 | 1/1949 | Wood | 273/319 |
| 3,107,094 | 10/1963 | Kfoury | 273/413 |
| 3,992,007 | 11/1976 | Seeman | 273/413 |
| 4,093,225 | 6/1978 | Oliver | 273/413 |
| 4,188,033 | 2/1980 | Wells | 273/413 |
| 4,491,329 | 1/1985 | Nielsen | 273/413 |

FOREIGN PATENT DOCUMENTS

| | | | |
|---|---|---|---|
| 358792 | 10/1931 | United Kingdom | 273/200 R |
| 1513563 | 6/1978 | United Kingdom | 273/413 |

*Primary Examiner*—William H. Grieb

*Attorney, Agent, or Firm*—Bell, Seltzer, Park & Gibson

[57] ABSTRACT

Apparatus for a tetherball game which includes a pole having a helix mounted thereon, and a ball attached to a line the other end of the line being slidably attached to the helix so that the attachment can travel up or down the helix depending on the direction in which the ball is struck, and which includes means for indicating when the attachment reaches either end of the helix to show a win for one or the other player, the means including a divertible means which diverts the attachment when the attachment emerges from the helix, and is held captive by the means.

6 Claims, 4 Drawing Sheets

INDICATING MEANS FOR TETHERBALL GAME

REFERENCE TO RELATED APPLICATION

The present application contains subject matter which is related to that disclosed in applicant's copending application Ser. No. 07/548,143, filed July 3, 1990.

FIELD OF THE NVENTION

This invention relates to games of the tetherball type which include a helical guide on a pole from which the line attachment is free to emerge at the or either end of such helical guide.

In this specification the following terms have the ascribed meanings: "helical guide" includes (a)a a coil which s mounted above a vertical pole or around the top zone of a pole (b) a volute or helix comprising a vane or thread formed around the top zone of a pole.

"Tetherbll" is a ball game played with apparatus including a vertical pole to which a ball is attached by a line to the top zone of the pole. The line attachment is free to rotate about the pole so the line does not become wound around the pole during play and remains at its full length. The ball is struck by one or more players generally using rackets or paddles for rotation in a generally semi-horizontal plane. The design must be capabIe of accommodating play in the vertical and horizontal planes without vertical slippage of the line attachment on the helical guide. The players normally take turns to strike the ball, each striking in the opposite direction to the other.

A feature of many tetherball games is the provision of a helical guide at the top of the pole, which causes the line attachment to move up or down depending on the direction of strike.

When the line attachment reaches either end of the helical guide this can be taken to indicate the end of a "game".

Having regard to FIG. 1 of the accompanying drawings, tetherball games include:

(a) a pole 12

(b) a ball 20 which is normally tennis ball-sized and is attached to the line remote from the pole. The ball may be hit about the pole in a nearly totally vertical plane as well as horizontal (c) a line 18

(d) a line attachement 16 which comprises a coupling device at the end of the line remote from the ball used rotationally to attach the line to the helical guide 14.

As the ball is continually hit in one direction by a player, the line attachment will move up or down the helical guide. The opponent, hitting in the opposite direction, will cause the 1ine attachment move in the opposite direction. One player will attempt to drive the line attachment in one direction on the helical guide to the end thereof, thereby winning and his opponent will try to prevent this and, conversely, will try to drive the line attachment in the opposite direction to the other end of the helical guide.

In some games an indicator means is provided for a positive indication that the line attachment has reached the top or bottom of the helical guide.

PRIOR ART

There are prior art patents relating to methods of indicating the end of tetherball games.

The main types fall into the following categories:

1. The end of the game is indicated by the line attachment reaching the top or bottom of the helical guide but unable to exit from the top or bottom. An example of this is U.K. Patent 1 513 563 (R G Gaffney). In which the line attachment is prevented from rotation once it reaches a stop at either end of the helical guide from which it is not free to emerge. There is nothing to prevent the line attachment being reversed in its direction of rotation as it approaches a given end of the helical guide and should this happen at about the moment the line attachment reaches either end there can be doubt as to whether the end has been reached.
2. The end of the game is indicated by exiting of the line attachment from the helical guide. An example of this is U.S. Pat. No. 3 107 094 (G.S. Kfoury). This game includes a coil aIong which a line attachment slides. The top end of the coil has a stop which halts the line attachment at this point. The bottom end of the coil, however, has no stop and the line attachment is free to slide down a vertical stem connecting the coil to the pole. The junction of the verticaI stem with the top of the pole forms a shoulder on which the line attachment is free to rotate about the axis of the poIe and which also acts as a stop. The end of the game is indicated when the line attachment reaches the bottom of the coil and slides down the vertical stem.
3. Signalling Means —These games provide a signal when the line attachment reaches either end of the helical guide.

In U.S. Pat. No. 3 992 007 (A. Seeman —the game makes provision for the ne attachment to actuate an alarm once it reaches either end of the helical guide.

In U.S. Pat. No. 4 491 329 (0.K. NieIsen) —the game is provided with a spring-loaded inner sleeve which is pressed down into a cocked position at the start of a game and is released by the contact of the line attachment with triggering formations at either end of the helical guide. The popping up of the sleeve into its released position provides a visual signal of the end of the game.

In neither of these patents does the line attachment leave the helical guide upon actuation of the indicating means.

In U.S. Pat. No. 4 188 033 (Wells) a signal is derived from a sleeve which is slidable on a pole inside a helical guide and which is cocked against spring means at the start of a game and triggering means are provided top and bottom for releasing the sleeve whereupon an aural and visual signal is emitted.

OBJECT OF THE INVENTION

The object of the invention in relation to games of the tetherball type having a helical guide for the line attachment is to provide an improved form of positive and distinctive indicatIon when the line attachment emerges from the top end of the helicaI guide.

SUMMARY OF THE INVENTION

According to the invention a tetherball game includes:

1. a vertically mounted pole;
2. a ball;
3. a line connecting the ball to the pole;

4. a line attachment at the end of the line remote from the ball which couples the line to a helical guide on the pole and which is free to rotate about the helical guide to move up or down the zone depending on the direction in which the ball is struck; the helical guide being free at either end to permit the line attachment to emerge from the helical guide;

characterised by the inclusion of means to divert the line attachment from a terminal position on the helical guide to a temporary captive position immediately upon the line attachment emerging from the helical guide, the captive position being displaced from the axis of the helical guide.

In one form of the invention the diverting means comprises a flexible element extending from the top of the helical guide and terminates in a stop member for the line attachment. The combination of flexible element and stop member provides a free rotation of the line attachment when it emerges from the helical guide. The rotation of the stop a distance away from the helical guide provides an excellent visual signal for the end of a game.

The flexible element may comprise a line which passes through an aperture in the top of the pole. A small mass may be attached to the line inside the pole to provide tensioning means so that the stop is biased to a position just above the helical guide. The mass should be heavier than the combination of the flexible element and the stop for this purpose. Alternatively a tension spring may be provided in the pole and attached to the line to provide the required tension.

In an alternative form of the invention the diverting means includes a goose neck formation just above the helical guide so that the line attachment deviates from its path on the helical guide to constitute a visual signal due to the fact that the line attachment will "free wheel" on the goose neck.

In a yet further form of the invention the directing means includes a flexible shaft as an extension of the helical guide, the flexible shaft having a stop for the line attachment, the flexible shaft having a degree of flexibilty sufficient to be bent out of the axis of the helical guide due to the centrifugal force exerted by the ball on the line attachment when the latter emerges from the helical guide.

A separate coil spring type is shown in U.S. Pat. No. 3 107 094 of G.S. Kfoury and it may be possible to extend the coil spring vertically upwards at the top end to form a straight vertical shaft surmounted by a stop. This could be said to be outwardly similar in appearance to the embodiment under discussion and it could be argued that shoud the line attachment rise up this shaft any tension on it could cause the vertical shaft to bend slightly in relation to the vertical axis of the main coil spring.

This movement, however, would not be significant as the material from which the coil spring is made has to be relatively rigid in order to hold its shape during play. Any vertical shaft which is merely an extension of the coil spring with no change in the material is not likely to bend significantly in relation to the coil spring. It is therefore submitted that a game of this type is not the same as the present invention.

DESCRIPTION OF THE DRAWINGS

Several embodiments of the invention are described below with reference to the accompanying drawings, in which.

DETAILED DESCRIPTION OF THE PREFERRED EMBODIMENTS

Figure 1:
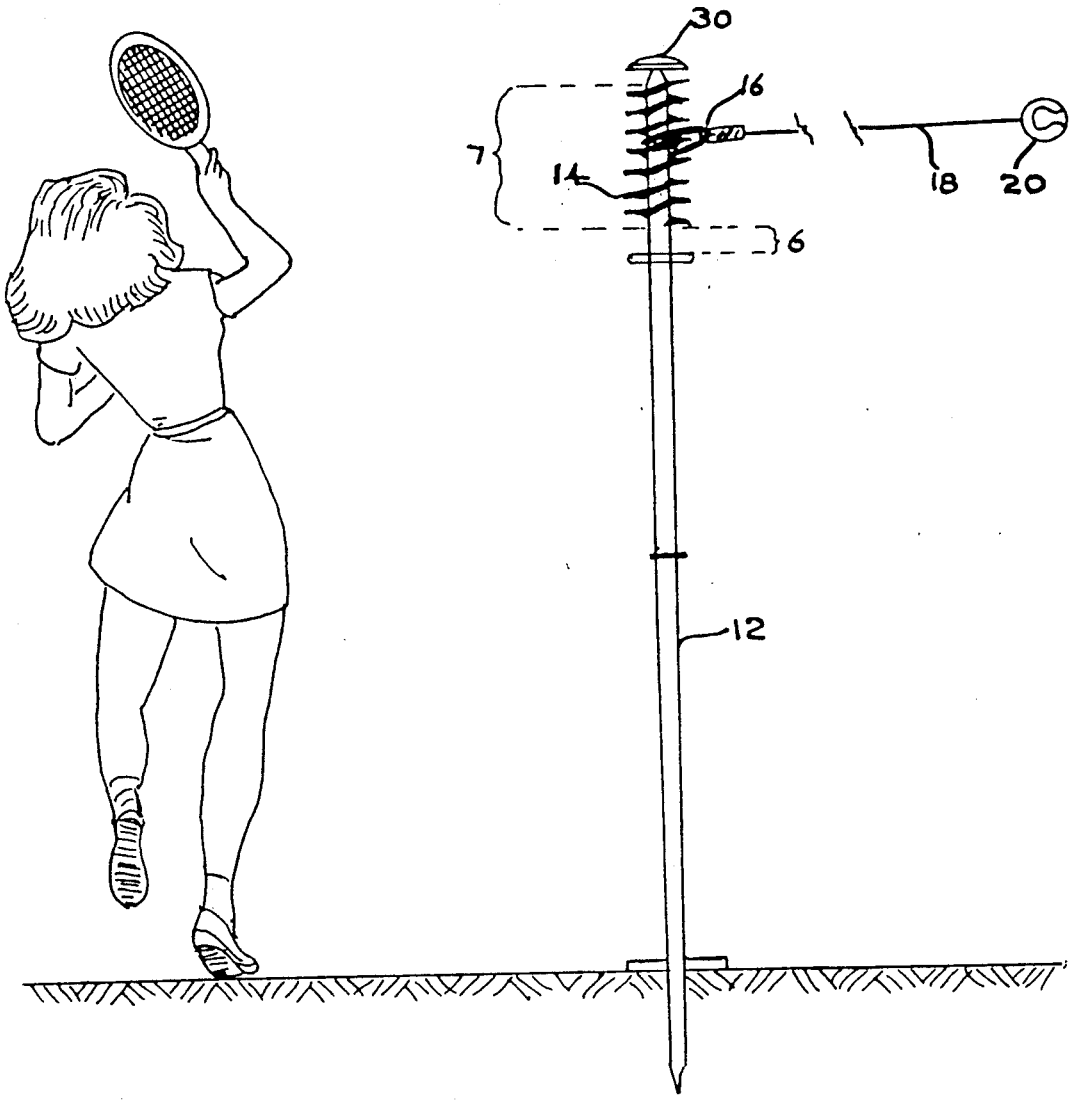
FIG. 1 is a side view of the complete apparatus according to the invention during play.

Referring to FIG. 1, apparatus for a tetherball game is shown including a vertical pole 12 with a helical guide 14, being a solid vane mounted thereon. The helical guide 14 has a height indicated by the numberal 7, and a stop member 15 is mounted on the pole below the helical guide 14 a distance which is indicated by the numeral 6. A line attachment in the form of a flexible noos 16 attaches a line 18 to a ball 20. A displaceable retaining flange 30 is provided on top of the pole. This is referred to below and in the claims as a stop.

Figure 2:
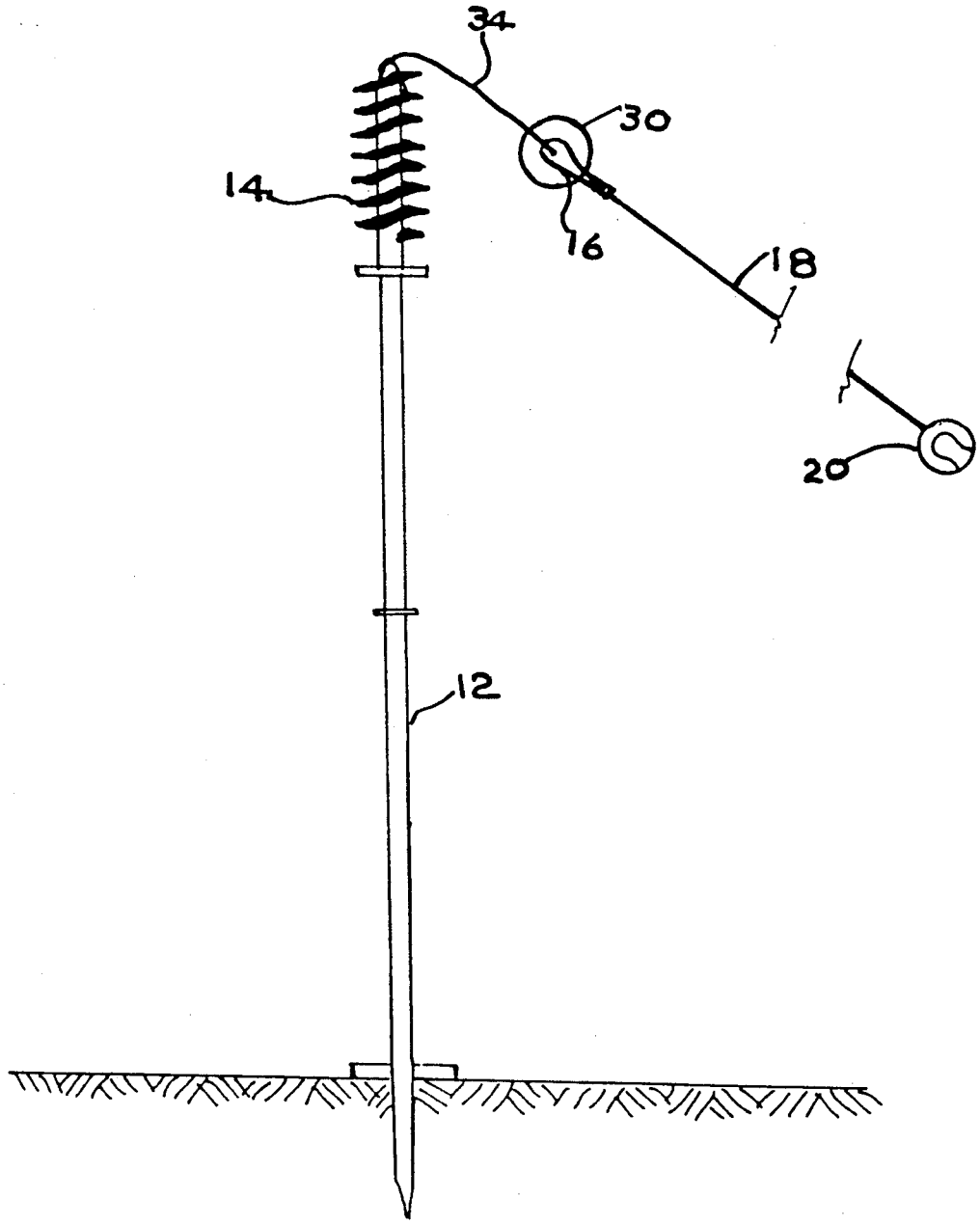
FIG. 2 is a side view of the same apparatus showing the retaining flange in its displaced position, the line attachment having emerged from the helical guide at the top.

FIG. 2 shows the complete apparatus of FIG. 1 with a stop 30 at the end of a line 34. The stop is free to twist and is shown as an under view with the flexible noose 16 trapped around the line 34 under the stop 30.

Figures 3, 4, 5:
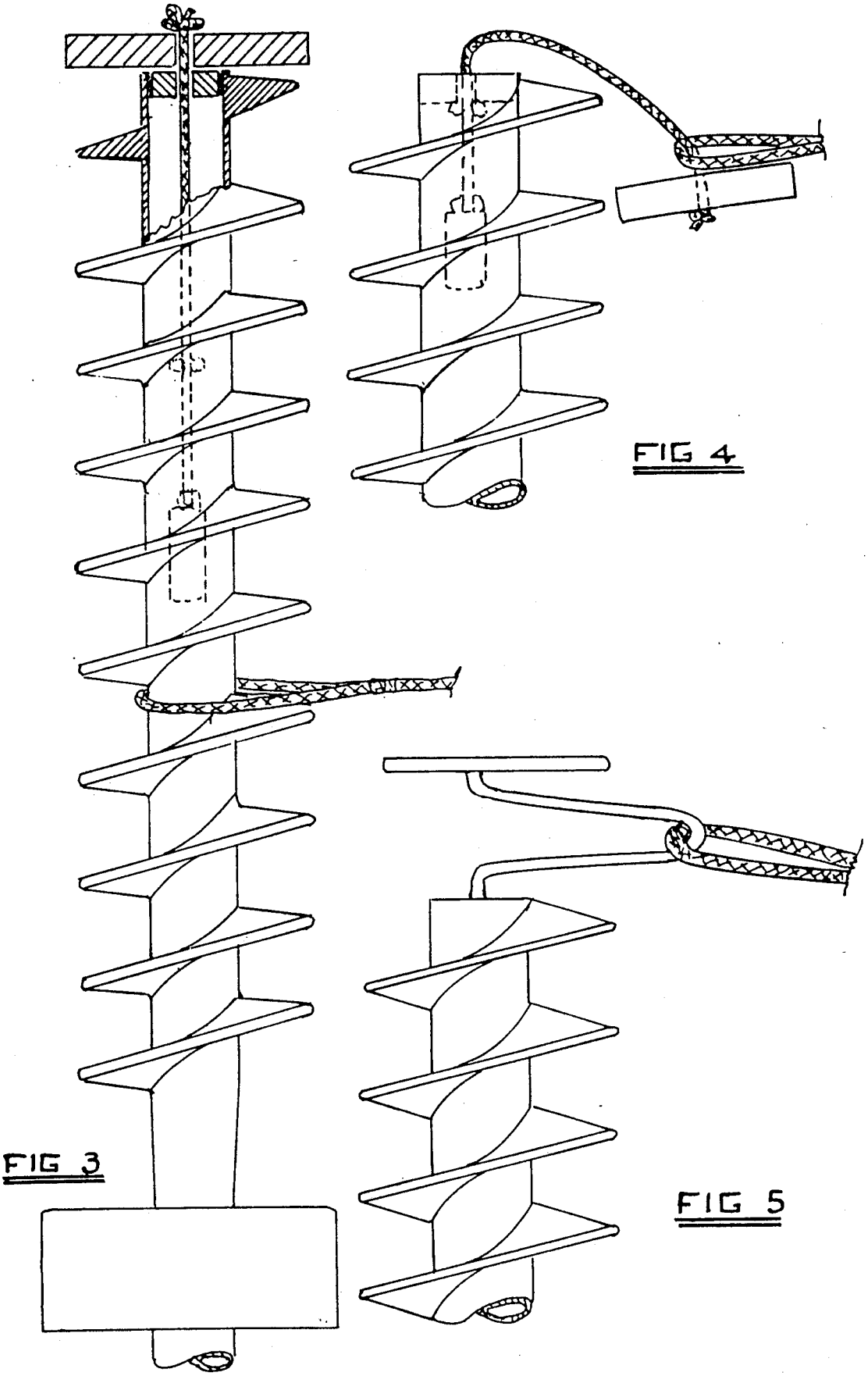
FIG. 3 is a side view of the top area according to the invention in its playing position; likely to bend significantly in relation to the coil spring. It is
FIG. 4 is a similar view showing the retaining flange displaced from its position on the vertical axis of the helical guide.
FIG. 5 is a similar view of an alternative form of the invention showing a "goose neck" device.

Referring to FIGS. 3 and 4, a stop 30 is provided which sits on top of the pole and is held there by a mass 32 depending from the line 34 which is free to pass easily through a hole 38. A knot 36 is provided on the line to restrict movement of the line out of the pole. As the line attachment 16 emerges from the top end of the helical guide 14 it causes the stop 30 to be displaced to the position as shown in FIG. 4.

When the line attachment is replaced on the helical guide to commence the next game the stop is pulled back automatically to its normal resting position at the top of the pole by the weight of the mass which is greater than that of the stop and the portion of the line above the knot 36.

In FIG. 5 a goose neck formation 42 is provided, having a bend in which the line attachment is trapped when it emerges from the helical guide. The goose neck device may be free to rotate.

Figure 6:
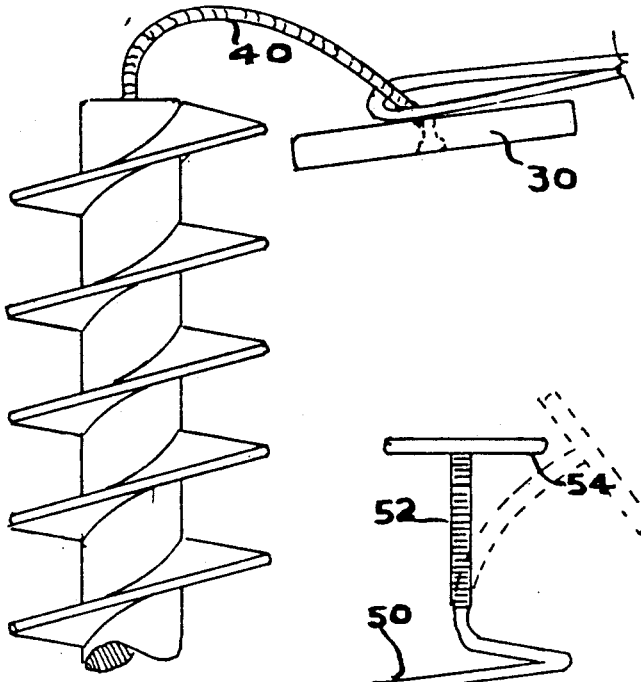
FIG. 6 is a similar view of a yet further alternative form of the invention showing the retaining flange attached to a flexible element above a game of the type showing in FIGS. 3 and 4.

In FIG. 6 the stop 30 is mounted on a spring, flexible stem or cord 40. The result is the same as in FIG. 4 except the degree of displacement is less.

Figure 7:
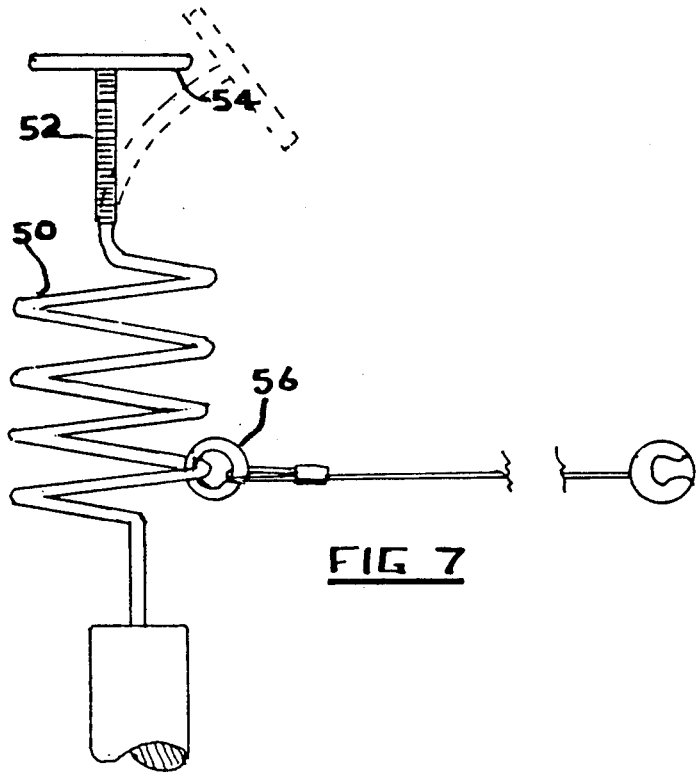
FIG. 7 is a similar view of another alternative form of the invention as applied to a game of the coil spring type.

In FIG. 7 a flexible shaft is mounted at the top of a coil type of apparatus. The coil 50 is vertically surmounted by a flexible shaft or spring stem 52 with a stop 54 fastened to its stop end. When the line attachment consisting of a ring 56 reaches the top of the coil 50 it will slide on the flexible shaft 52 and the centrifugal force on the ring will cause the flexible shaft to bend sideways. The ring 56 will then slide to the end of the flexibIe shaft to a position where it abuts the stop similar to the position shown in FIG. 6.

Figure 8:
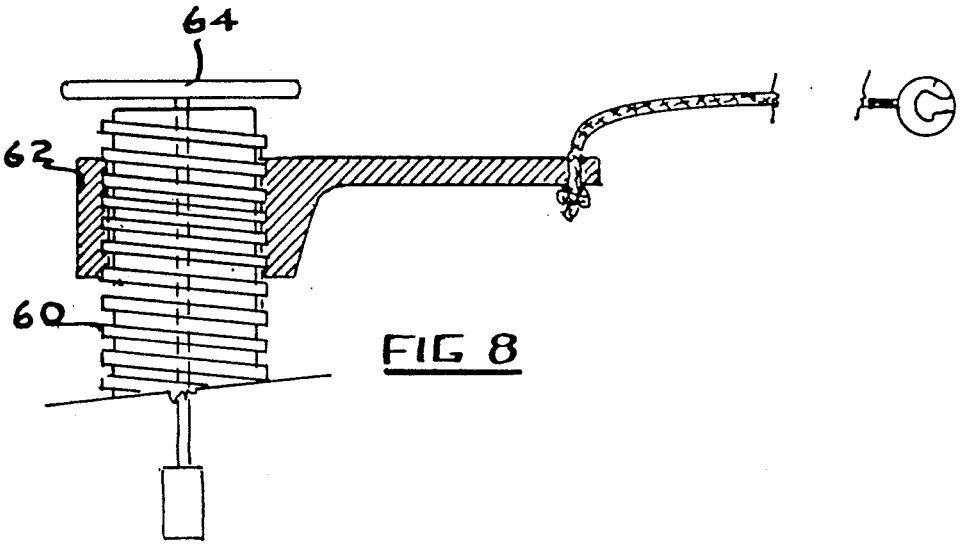
FIG. 8 is a similar view of another form of the invention as applied to a nut and bolt type of game.

In FIG. 8 apparatus of the nut and bolt type is shown having a boIt member 60, a nut 62 for attachment of the line to the ball and a stop 64 and mass arrangement similar to that of FIGS. 3 and 4.

The nut 62 is free to emerge from the threaded portion of the bolt member 60.

I claim:

1. Apparatus for a tetherball game including:

a vertically mounted pole;

a ball;

a line connecting the ball to the pole;

a line attachment at the end of the line remote from the ball which couples the line to a helical guide on the pole and which is free to rotate about the helical guide to move up or down the helical guide depending on the direction in which the ball is struck; the helical guide being free at either end to permit the line attachment to emerge from the helical guide; and characterised by the inclusion of means to divert the line attachment from a terminal position on the helical guide to a temporary captive position immediately upon the line attachment emerging from the helical guide, the captive position being displaced from the axis of the helical guide.

2. Apparatus according to claim 1 in which the diverting means comprises a flexible element extending from the top of the helical guide and terminating in a stop member for the line attachment.

3. Apparatus according to claim 2 in which the flexible element is a line slidable through an aperture in the pole and movable between a first position in which the stop member is adjacent the top of the helical guide and a second position in which the stop member is moved away from its first position on account of the emergence of the line attachment from the helical guide.

4. Apparatus according to claim 3 in which the line has tensioning means biasing it to the first position.

5. Apparatus according to claim 1 in which the diverting means includes a goose neck formation for receiving the line attachment in free rotational relationship.

6. Apparatus according to claim 1 in which the diverting means includes a flexible shaft as an extension of the helical guide, the flexible shaft having a stop for the line attachment, the flexible shaft having a degree of flexibility sufficient to be bent out of the axis of the helical guide due to the centrifugal force exerted by the ball on the line attachment when the latter emerges from the helical guide.

* * * * *

UNITED STATES PATENT AND TRADEMARK OFFICE

CERTIFICATE OF CORRECTION

PATENT NO. : 5,024,446

DATED : June 18, 1991

INVENTOR(S) : Neville M. Norman

It is certified that error appears in the above-identified patent and that said Letters Patent is hereby corrected as shown below:

Column 1, line 9, "NVENTION" should be -- INVENTION --

Column 1, line 17, "s" should be -- is --

Column 1, line 58, "1ine" should be -- line --

Column 2, line 9, "(R G Gaffney). In" should be -- (R G Gaffney), in --

Column 2, line 35, after "Seeman" insert -- ) --

Column 2, line 38, "NieIsen" should be -- Nielsøn --

Column 2, line 60, "indicatIon" should be -- indication --

Column 3, line 4, delete "zone" and insert -- helical guide --

UNITED STATES PATENT AND TRADEMARK OFFICE

CERTIFICATE OF CORRECTION

PATENT NO. : 5,024,446

DATED : June 18, 1991

INVENTOR(S) : Neville M. Norman

It is certified that error appears in the above-identified patent and that said Letters Patent is hereby corrected as shown below:

Column 3, line 47, "possibIe" should be -- possible --

Column 3, line 52, "shoud" should be -- should--

Column 3, line 64, before "DESCRIPTION" insert -- BRIEF --

Column 4, line 8, delete "likely to bend significantly in relation to the coiI spring. It is"

Column 4, line 30 "numberal" should be -- numeral --

Column 4, line 34, "noos" should be -- noose --

Column 4, line 65, "stop" should be -- top --

Column 5, line 2, "stop" should be -- top --

Column 5, line 5, "boIt" should be -- bolt --

Signed and Sealed this

Twenty-ninth Day of December, 1992

*Attest:*

DOUGLAS B. COMER

*Attesting Officer*

*Acting Commissioner of Patents and Trademarks*